United States Patent [19]

Cintolo

[11] Patent Number: 4,947,745

[45] Date of Patent: Aug. 14, 1990

[54] APPLICATION OF VARNISH TO SHEETS OF PAPER OR CARD

[75] Inventor: John P. Cintolo, Bulleen, Australia

[73] Assignee: Spicers Paper Limited, Victoria, Australia

[21] Appl. No.: 288,089

[22] Filed: Dec. 22, 1988

[30] Foreign Application Priority Data

Dec. 24, 1987 [AU] Australia ..... P16069/87

[51] Int. Cl.[5] ..... B41F 7/04; B41F 7/26; B41F 31/10

[52] U.S. Cl. ..... 101/142; 101/148

[58] Field of Search ..... 101/148, 350, 349, 363, 101/364, 207–210, 217, 218, 137, 142, 143, 144, 177, DIG. 32; 118/244, 258, 259, 261

[56] References Cited

U.S. PATENT DOCUMENTS

| | | | |
|---|---|---|---|
| 3,835,597 | 9/1974 | Wasil | 101/148 |
| 3,902,417 | 9/1975 | Fischer | 101/148 |
| 3,911,816 | 10/1975 | Hutton | 101/148 |
| 4,048,919 | 9/1977 | Woods | 101/148 |

*Primary Examiner*—J. Reed Fisher

*Attorney, Agent, or Firm*—Birch, Stewart, Kolasch & Birch

[57] ABSTRACT

Application to areas of the successive rollers and cylinders in a printing press, of liquid from the water duct which will not eventually be transferred to the material being printed, is avoided by using a vibrator roller and at least one damper roller of the same width as the sheet of material being printed, while the oscillator roller, the plate cylinder, the blanket cylinder and the impression cylinder are wider than the sheet.

8 Claims, 1 Drawing Sheet

APPLICATION OF VARNISH TO SHEETS OF PAPER OR CARD

Figure 1:
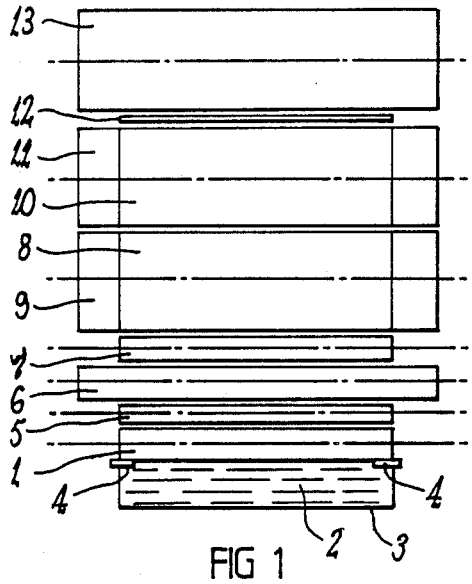

This invention relates to the application of varnish or similar material to sheets of paper or card. The invention has been developed in connection with the application of the varnish coating applied to provide the required finish to playing cards and will be described in the following specification with reference to this application. It is to be understood however that the process of the invention is broadly applicable to the application of varnish or other coatings to paper, card or other sheet materials so that the specific description which follows is not to be construed as limiting the scope of the invention.

In the production of playing cards, sheets are printed with one or more sets of the images required to make up a full pack of the cards applicable to the card game concerned. The required images will normally be printed onto the sheets using a conventional offset or a dry offset printing press. After printing of the sheets, separate cards are cut from the sheets and stacked to form the packs of cards which are then appropriately packaged and sold in their packaged form.

In order to increase the life of a pack of cards, it is common practice to coat the cards with a varnish which will not only strengthen the material from which the cards are formed but will also be resistant to soiling, will improve the slippage properties desirable in shuffling and dealing, and give the cards other desirable properties as appreciated by those skilled in the art. The application of such coatings is conveniently achieved before the individual cards are separated from the sheet on which they are initially printed.

In order to enable mass production of cards at a reasonable rate, the varnish coating applied should be capable of rapid drying. However, the requirement for rapid drying of the varnish applied to the sheet of cards causes problems in the applying machinery, particularly problems caused by build-up of dried varnish on the machinery used. Varnish build-up is particularly noticable in areas of the machinery where varnish can accumulate without removal by coating onto successive sheets being fed through the machine.

For this reason, a specific machine, which can be taken out of use and cleaned at regular intervals, is generally used for applying a varnish coating. The need for a separate machine which must periodically be taken out of production or for a stand-by machine to enable substantially continuous production, adds to the difficulties and expense in producing coated sheets of this kind.

It is therefore an object of the invention to provide a machine which will enable the substantially continuous production of coated sheet materials over an extended period without undesirable build-up of the coating material.

In accordance with the invention it has been found that a water based varnish providing optimum properties to the finished cards can be applied by a modified offset printing press. In offset printing presses as normally used to apply an ink image to sheets of paper or like material, at least one group of applicator rolls is designed to carry an appropriate liquid to the cylinders which transfer the desired image to the sheets. A conventional or lithographic offset printing press has two groups of applicator rolls; one group carries ink, the other group carries water. A dry offset printing press uses a different form of printing plate to that used in a conventional offset press and has only one group of applicator rolls, which carry ink to the printing plate.

Accordingly, the present invention provides a printing press including:

- a water duct,
- a water duct roller having an outer surface, said roller being located to rotate with its outer surface partly immersed in liquid carried by said water duct,
- vibrator roller having an outer surface located to cooperate in use with said water duct roller,
- an oscillator roller located to cooperate in use with said vibrator roller,
- at least one damper roller located to cooperate in use with a printing plate carried by a plate cylinder,
- said plate cylinder located to cooperate in use with a printing blanket on a blanked cylinder,
- said blanket cylinder being located to cooperate in use with an impression cylinder,
- whereby in use said liquid picked up from the water duct by the water duct roller is transferred from the water duct roller to cover the outer surface of the vibrator roller, is transferred successively from the vibrator roller to the oscillator roller, to the damper roller(s), to the printing plate, to the printing blanket, and from the printing blanket to a sheet of paper or like material passing between the blanket cylinder and the impression cylinder, and wherein the vibrator roller and the or each damper roller are the same width as said sheet.

As in conventional offset printing presses, the modified press of the present invention includes a vibrator roller and an oscillator roller. In the modified press of the present invention these rollers operate in known manner to assist the even application of the liquid from the water duct to the paper or like material fed between the blanket cylinder and the impression cylinder. The liquid from the water duct is carried in use via the water duct roller in the vibrator roller and thence to the succeeding rollers and cylinders.

Thus, the present invention provides a modified offset printing press adapted to apply varnish through a group of applicator rolls similar to the water applicator rolls of a conventional offset press. This group of applicator rolls includes a water duct roller having an outer surface and being located to rotate with its outer surface partly immersed in liquid, such as water-based varnish, carried by a water duct or trough.

In accordance with the invention the water duct roller of a conventional offset printing press may be reduced in width to approximate the width of the sheet of paper or like material to which varnish is to be applied. The width of the water duct roller is preferably slightly less than that of the material being varnished. Alternatively, the water duct roller may be of conventional size; in this embodiment the effective width of the water duct roller is preferably reduced by varnish reducing means as described below.

The use of one of these modifications, may avoid the application to the succeeding rollers and cylinders of excess varnish which will otherwise accumulate beyond the edges of the sheet being coated.

The effective width of the water duct roller can be reduced in accordance with the width of the sheet being varnished. Preferably the outer edges of the water duct roller are provided with means to remove or reduce the amount of varnish passed on by the water duct roller to the succeeding roller of the machine. These means may be appropriate squeeze rollers or doctor blades which function to remove or reduce the amount of varnish at the outer ends of the water duct roller. Alternatively or additionally, other means such as appropriately directed air blowers can be used to reduce the amount of varnish at the end edges of this roller.

The water duct roller is used to pick up water based varnish from the water duct and transfer it through the other rollers of the applicator rolls group to the plate cylinder and blanket cylinder system to the sheet of material to be coated.

It is sometimes found that the greater viscosity of the water based varnish as compared with the water normally applied to the water duct roller can cause problems of throwing or splashing of the varnish solution as the water duct roller rotates with its surface in the trough or other reservoir of varnish solution. Accordingly, it is preferred to provide a knurled or otherwise roughened surface on the duct roller to improve the pick-up and retention of the water based varnish by this roller. Further modification of the water duct roller by increasing the diameter of this roller above that of a normal water duct roller may also be used to improve the pick-up and retention of the water based varnish.

The applicator roll to which varnish is transferred by the water duct roller is a vibrator roller. The vibrator roller has an outer surface and operates in a similar manner to the vibrator roller of a conventional offset press and transfers the varnish to an oscillator roller. However, the vibrator roller used in the present invention is reduced in width to that of the sheets of material to which varnish is to be applied. This reduction in width assists in avoiding excess varnish being applied to the plate cylinder, blanket cylinder and impression cylinder beyond the edges of the sheet being coated.

The oscillator roller functions as in a conventional offset press to evenly distribute the varnish and transfer it to at least one, preferably two, damper rollers. The damper roller width is also reduced to that of the sheets to which the varnish is to be applied. Thus the application of excess varnish beyond the edges of the sheets can again be substantially reduced or avoided.

The varnish transferred to the damper roller(s) is in turn transferred directly to a printing plate carried by a printing cylinder. Preferably the plate is reduced in width and aligned to correspond with the width of the sheets to which the varnish is to be applied. Unlike the printing plate in a conventional offset press and unlike the different form of printing plate in a dry offset press, the printing plate used in the present invention is required to transfer the liquid applied over the whole plate surface to a printing blanket carried by a blanket cylinder. Accordingly the surface of the printing plate used in the present invention is preferably treated for example by etching, to assist the uniform pick-up and transfer of the applied varnish.

The printing blanket carried by the blanket cylinder is preferably reduced in width and aligned to correspond with the width of the sheets to which the varnish is to be applied. In accordance with standard offset printing press construction, the sheets being printed pass between the printing blanket and an impression cylinder which assists in the transfer to the sheets of the varnish which has been carried through the press.

In the modified press of the invention, the group of applicator rolls used in a conventional offset press or in a dry offset press to transfer and apply printing ink to the sheets being printed, is not required when the press is used for varnish application. However, a conventional offset press can be modified for use in accordance with the present invention by removing, when varnish is to be applied, the inking rollers normally contacting the printing plate. These inking rollers can be replaced if the press is to be used to print in its normal manner.

Accordingly, it will be appreciated that a single modified offset printing press stage can be used successively to print the required design on the sheets of material and then to apply the required varnish coating. Alternatively, a two stage printing press can be operated with a normal printing stage and varnish application stage of the invention in line to improve production speed and reduce handling of the material being printed.

In order to assist further in understanding the present invention, reference is made to the accompanying drawings where a preferred form of modified offset printing press is illustrated diagramatically. In the drawings, FIG. 1 is a plan view in which the components have been separated somewhat for greater clarity.

Figure 2:
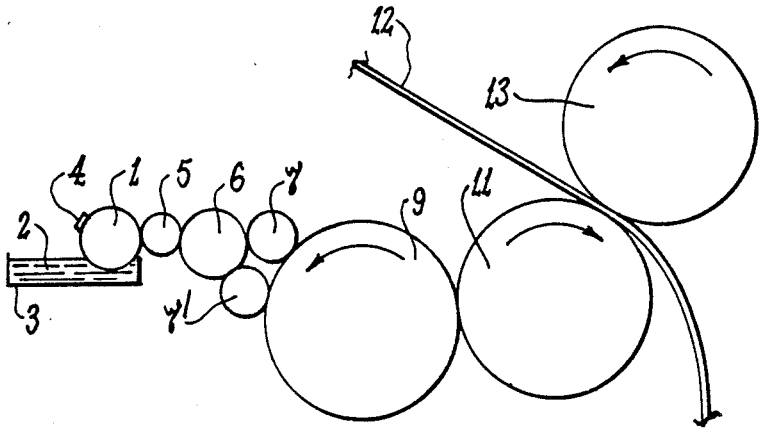

FIG. 2 is an end view (to a larger scale) in which the relative configuration of the rollers is shown more accurately and the location of the water duct is also shown.

The same reference numerals are used in both figures to designate the same features. Water duct roller 1 is partly immersed in liquid 2 contained in water duct 3. Liquid picked up by roller 1 may be removed from the edges of this roller by reducing means such as squeezers 4 which press against the edges of roller 1 outside duct 3 and remove excess liquid before the liquid carried from duct 3 by roller 1 is transferred to vibrator roller 5.

If water duct roller 1 is of conventional width, (corresponding to the width of roller 6 and cylinders 9, 11 and 13 in FIG. 1) water duct 3 will be of similar width to accomodate roller 1. Reducing means such as squeezers 4 will be designed to remove liquid 2 from the outer edges of roller 1 and provide a band of liquid for transfer to roller 5 of similar width to roller 5. Alternatively, as noted above the reducing means can be omitted.

The liquid is transferred from roller 5 to oscillator roller 6 and from roller 6 to damper rollers 7, 7'.

Damper rollers 7, 7' transfer the liquid to the surface of printing plate 8 carried by plate cylinder 9. The liquid which covers the entire surface of plate 8 is then transferred to printing blanket 10 carried by blanket cylinder 11. Sheet 12 which is fed between cylinder 11 and impression cylinder 13 by the indicated rotation of these cylinders receives the liquid from blanket 10.

It will be noted that, in the illustrated embodiment, rollers 1, 5, 7 and 7', as well as plate 8 and blanket 10 are of the same width as sheet 12.

It is to be understood that this illustration is given by way of example only and is not to be construed as limiting the scope of the present invention. Similarly, as noted above, the specific embodiment described is not to be taken as limiting the inventive concept which can, of course, be applied more broadly than the application of varnish or similar liquids to sheets of paper or like material.

I claim:

1. A printing press including:

a water duct, a water duct roller having an outer surface, said roller being located to rotate with its outer surface partly immersed in liquid carried by said water duct, a vibrator roller having an outer surface located to cooperate in use with said water duct roller, an oscillator roller located to cooperate in use with said vibrator roller, a plate cylinder, a printing plate carried by the plate cylinder, at least one damper roller located to cooperate in use with the printing plate carried by the plate cylinder, a blanket cylinder, a printing blanket on the blanket cylinder, said plate cylinder located to cooperate in use with the printing blanket on the blanket cylinder, an impression cylinder located to cooperate in use with said blanket cylinder, whereby in use with liquid picked up from the water duct by the water duct roller, is transferred from the water duct roller to cover the outer surface of the vibrator roller, is transferred successively from the vibrator roller to the oscillator roller, to the at least one damper roller, to the printing plate, to the printing blanket, and from the printing blanket to a sheet of paper-based material passing between the blanket cylinder and the impression cylinder, and wherein the vibrator roller and the at least one damper roller are the same width as said sheet and at least the oscillator roller, the plate cylinder, the blanket cylinder and the impression cylinder are wider than said sheet.

2. A printing press as claimed in claim 1 wherein the surface of the water duct roller is roughened to improve pick-up and retention of the liquid.

3. A printing press as claimed in claim 1 wherein the printing plate is the same width as said sheet.

4. A printing press as claimed in claim 1 wherein the printing blanket is the same width as said sheet.

5. A printing press as claimed in claim 1 wherein the water duct roller is the same width as said sheet.

6. A printing press as claimed in claim 1 wherein the water duct roller is wider than said sheet.

7. A printing press as claimed in claim 6 wherein liquid reducing means is located at each end of the water duct roller to reduce the effective width of the liquid transferred from the water duct roller to the vibrator roller.

8. A printing press as claimed in claim 7 wherein said liquid reducing means is selected from the group consisting of squeeze rollers, doctor blades and air blowers.

* * * * *